US010047756B2

(12) United States Patent
Yang et al.

(10) Patent No.: US 10,047,756 B2
(45) Date of Patent: Aug. 14, 2018

(54) VENTILATING FAN

(75) Inventors: Zhenjian Yang, Guangdong (CN); Shouyong Gao, Guangdong (CN); Jingtao Yang, Guangdong (CN); Min Long, Guangdong (CN); Zewei Rao, Guangdong (CN); Jianrong Zhu, Guangdon (CN)

(73) Assignees: PANASONIC ECOLOGY SYSTEMS GUANGDONG CO., LTD., Foshan, Guangdong (CN); PANASONIC CORPORATION, Osaka (JP)

( * ) Notice: Subject to any disclaimer, the term of this patent is extended or adjusted under 35 U.S.C. 154(b) by 810 days.

(21) Appl. No.: 13/634,032

(22) PCT Filed: Feb. 10, 2011

(86) PCT No.: PCT/CN2011/000209
§ 371 (c)(1),
(2), (4) Date: Oct. 11, 2012

(87) PCT Pub. No.: WO2011/113297
PCT Pub. Date: Sep. 22, 2011

(65) Prior Publication Data

US 2013/0072105 A1 Mar. 21, 2013

(30) Foreign Application Priority Data

Mar. 17, 2010 (CN) ..... 2010 1 0130174
Mar. 17, 2010 (CN) ..... 2010 1 0130195

(51) Int. Cl.
*F24F 7/013* (2006.01)
*F04D 5/00* (2006.01)
(Continued)

(52) U.S. Cl.
CPC ..... *F04D 25/08* (2013.01); *F04D 29/422* (2013.01); *F04D 29/4213* (2013.01);
(Continued)

(58) Field of Classification Search
CPC ..... F04D 25/08; F04D 29/422
(Continued)

(56) References Cited

U.S. PATENT DOCUMENTS 1,526,917 A * 2/1925 Leland ..... F03B 3/186 72/337
2,225,398 A * 12/1940 Hamblin ..... 415/119
(Continued)

FOREIGN PATENT DOCUMENTS

CN 2748674 12/2005
CN 1752460 3/2006
(Continued)

OTHER PUBLICATIONS

Yang, CN 2748674 Y English machine translation, Dec. 28, 2005.*
(Continued)

*Primary Examiner* — Kenneth Rinehart
*Assistant Examiner* — Phillip E Decker
(74) *Attorney, Agent, or Firm* — RatnerPrestia

(57) ABSTRACT

A ventilating fan includes a sirocco fan disposed in a box-shaped body and an adapter connected to an air outlet of the sirocco fan. The sirocco fan is composed of two opposite scroll plates with scroll shapes and a casing plate sandwiched between the two scroll plates. An overall air inlet of the sirocco fan is disposed on the first scroll plate and a central line of the air outlet of the adapter is offset towards the second scroll plate. The present invention is advantageous in that no turbulence is generated at the adapter and the wind amount of the ventilating fan is thus ensured and noise is reduced. Therefore, the present invention can provide a small air blowing device with high efficiency and improve stability of performance of the product.

14 Claims, 12 Drawing Sheets

(51) Int. Cl.

| | |
|---|---|
| ***F04D 25/08*** | (2006.01) |
| ***F04D 29/42*** | (2006.01) |
| ***F04D 29/62*** | (2006.01) |
| ***F04D 29/66*** | (2006.01) |
| ***F04D 29/44*** | (2006.01) |

(52) U.S. Cl.
CPC ..... *F04D 29/4226* (2013.01); *F04D 29/441* (2013.01); *F04D 29/626* (2013.01); *F04D 29/663* (2013.01); *F05D 2250/51* (2013.01)

(58) Field of Classification Search
USPC ..... 454/347, 349, 350, 358, 359; D23/262, D23/266, 387, 391, 393
See application file for complete search history.

(56) References Cited

U.S. PATENT DOCUMENTS

| | | | | |
|---|---|---|---|---|
| 2,336,209 | A * | 12/1943 | Anderson | G01F 1/10 73/198 |
| 2,994,348 | A * | 8/1961 | Cape | B21D 51/24 138/172 |
| 3,145,912 | A * | 8/1964 | Weis | 415/124 |
| 3,727,953 | A * | 4/1973 | Martin | F16L 21/005 285/148.23 |
| 3,811,790 | A * | 5/1974 | Mikulina | F04D 29/4206 415/145 |
| 3,846,040 | A * | 11/1974 | Dennis | F04D 29/4226 415/204 |
| D297,043 | S * | 8/1988 | Vander Wilt | D23/263 |
| 5,690,881 | A * | 11/1997 | Horie et al. | 264/263 |
| 6,192,838 | B1 * | 2/2001 | Matsuo et al. | 123/41.01 |
| 6,203,423 | B1 * | 3/2001 | Craw et al. | 454/359 |
| 6,261,175 | B1 * | 7/2001 | Larson | F24F 7/007 454/354 |
| 6,488,579 | B2 * | 12/2002 | Larson et al. | 454/354 |
| 6,902,373 | B1 * | 6/2005 | Glanton | F04D 29/601 415/207 |
| 7,055,866 | B2 * | 6/2006 | Tempas | F16L 19/0218 285/148.22 |
| 7,203,416 | B2 * | 4/2007 | Craw et al. | 392/350 |
| 7,216,396 | B2 * | 5/2007 | Slawinski | A47L 5/14 15/301 |
| 7,286,350 | B2 * | 10/2007 | Lee | F04D 29/545 257/712 |
| D571,908 | S * | 6/2008 | Myers | D23/393 |
| D576,722 | S * | 9/2008 | Nishio | D23/393 |
| 7,418,763 | B2 * | 9/2008 | Shaver | A47L 5/14 15/330 |
| 7,473,070 | B2 | 1/2009 | Song et al. | |
| 8,876,582 | B2 * | 11/2014 | Gao | F24F 7/007 454/349 |
| 8,961,126 | B1 * | 2/2015 | Tom | F21V 29/02 454/293 |
| 9,028,212 | B1 * | 5/2015 | Tom | F04D 1/04 416/5 |
| 2005/0214114 | A1 | 9/2005 | Huang et al. | |
| 2007/0007762 | A1 * | 1/2007 | Hull | F16L 37/098 285/148.23 |
| 2008/0207111 | A1 * | 8/2008 | Stroehla | 454/262 |
| 2008/0233856 | A1 * | 9/2008 | Okawa | B60H 1/00564 454/143 |
| 2009/0170421 | A1 * | 7/2009 | Adrian et al. | 454/349 |
| 2009/0286462 | A1 * | 11/2009 | Goto | 454/155 |
| 2013/0130612 | A1 * | 5/2013 | Penlesky et al. | 454/237 |
| 2014/0037478 | A1 * | 2/2014 | Yuan et al. | 417/423.15 |
| 2014/0065940 | A1 * | 3/2014 | Penlesky et al. | 454/230 |
| 2014/0065945 | A1 * | 3/2014 | Zakula et al. | 454/322 |
| 2016/0208814 | A1 * | 7/2016 | Wu | F04D 29/441 |
| 2018/0023588 | A1 * | 1/2018 | Van Der Kooi | F04D 29/4226 |

FOREIGN PATENT DOCUMENTS

| | | | | |
|---|---|---|---|---|
| CN | 1763381 | | 4/2006 | |
| CN | 201347873 | | 11/2009 | |
| CN | 201621088 | | 11/2010 | |
| DE | 847739 | C * | 8/1952 | F04D 29/44 |
| DE | 4219642 | C1 * | 10/1993 | F04D 29/44 |
| JP | 2006046170 | A * | 2/2006 | |
| JP | 2007101145 | A * | 4/2007 | |

OTHER PUBLICATIONS

Jianrong, et al, CN 201347873 Y English machine translation, Nov. 18, 2009.*

International Search Report for International Application No. PCT/CN2011/000209, dated May 12, 2011.

* cited by examiner

100

2000

VENTILATING FAN

CROSS-REFERENCE TO RELATED APPLICATION

This application claims the benefit of Chinese Patent Application No. 201010130174.1 filed on Mar. 17, 2010, and Chinese Patent Application No. 201010130195.3 filed on Mar. 17, 2010 in the State Intellectual Property Office of China, the disclosure of which is incorporated herein by reference.

BACKGROUND OF THE INVENTION

1. Field of the Invention

The present invention relates to a structure of an air blowing device, and particularly to a ventilating fan in which a sirocco fan is provided.

2. Description of the Related Art

A known ventilating fan 100 is shown in FIG. 1. A sirocco fan 120 is disposed in a box-shaped body 110. An air is suctioned through an air inlet 111 at a bottom of the body 110 and discharged to the outdoors through an air outlet 112 on a side of the body 110. Furthermore, a metal adapter 1500 is disposed at the air outlet 112 on the side of the body 110 so as to discharge the air to the outdoors through the air outlet 112. The metal adapter 1500 is connected with a duct (not shown) communicating with the outdoors.

The air outlet 112 of the sirocco fan 120 has a square shape. However, one end of the duct communicating with the outdoors has a round shape. Meanwhile, an area of the air outlet 112 of the sirocco fan 120 is larger than a section area of the duct. Therefore, a wind path area is necessary to be reduced at the metal adapter 1500. As shown in FIG. 1, the square air outlet is evenly reduced to form a round shape. That is to say, opposite edges of the square of the air outlet 112 are symmetrically reduced from the outer circumference towards the center.

The above air blowing device of the prior art has the following problems: the air blown by the sirocco fan 120 is difficult to be smoothly transformed since the square shape of the air outlet 112 is different from the round shape of the duct. That is to say, the air blown by the sirocco fan 120 is not uniform and thus prone to generate turbulence although the air outlet is evenly reduced. The ventilating fan cannot ensure amount of the blown air due to this turbulence. Thus, a large sirocco fan is required to ensure the amount of the blown air. However, the large sirocco fan will generate stronger noise.

FIG. 5 shows a structurally schematic view of a metal adapter of a known ventilating fan. The metal adapter 1500 of the ventilating fan comprises an air guiding structure 1100 and a shutter 1200 mounted inside the air guiding structure 1100. The air guiding structure 1100 is divided into two parts: an air inlet 1110 and an air outlet 1120. The air inlet 1110 is connected to the casing (not shown) mounted with the fan and the air outlet 1120 is connected to the duct (not shown) communicating with outdoors. The air inlet 1110 has a square shape and the air outlet 1120 has a round shape. The square air inlet 1110 is gradually reduced while extending towards the round air outlet 1120. A sidewall 1130 forms a smooth transition between the air inlet 1110 and the air outlet 1120 so as to form a structure like funnel. The shutter 1200 entirely has a shape formed of a plane 1210 and a folded edge 1220. The shutter 1200 is mounted at a position close to outdoor side in the round air outlet 1120 via seven components such as glue sheaths 1230, rivets 1240, a rubber buckle 1250 and so on.

It is apparent from the above description that the known metal adapter 1500 is composed of the shutter 1200, the air guiding structure 1100, the two sheaths 1230, the two rivets 1240 and the rubber buckle 1250.

The inventors of the present invention have found that the above adapter structure of the prior art has the following disadvantages or problems:

The adapter structure cannot be smoothly connected with the casing provided with the fan since the area of the air inlet 1110 is too large. That is to say, the air outlet of the fan is sharply enlarged at the air inlet 1110. In this way, when wind generated by the fan is blown towards the air inlet 1110, the wind will collide with the sidewall 1130 of the air inlet so as to generate turbulence and the amount of the wind is thus reduced while noise is generated;

Since the shutter 1200 entirely has the shape formed of the plane and the folded edge, a slit is formed between the shutter 1200 and the round air outlet 1120, thereby causing poor air tightness (prone to reverse airflow into the indoor from the outdoor through the duct);

In addition, it is shown from FIG. 6 that the shutter 1200 is mounted at a position close to the outdoor side in the round air outlet 1120. Therefore, a screw 1300 may contact with the shutter 1200 and the shutter 1200 thus cannot be opened when an operator fixes the outdoor connecting duct 1210 to the air outlet by the screw 1300.

SUMMARY OF THE INVENTION

The present invention has been made to overcome or alleviate at least one aspect of the above mentioned disadvantages.

Accordingly, an object of the present invention is to provide a ventilating fan that can provide a greater wind amount with a sirocco fan having the same performance as described above.

Another object of the present invention is to provide a ventilating fan that can achieve a quieter operation with a sirocco fan having the same performance as described above.

For the above purposes, the present invention provides a ventilating fan that comprises a sirocco fan disposed in a box-shaped body and an adapter connected to an air outlet of the sirocco fan. The sirocco fan is composed of two opposite scroll plates with scroll shapes and a casing plate sandwiched between the two scroll plates. An overall air inlet of the sirocco fan is disposed on a first scroll plate, and a central line of the air outlet of the adapter is offset towards a second scroll plate.

The adapter has a square air inlet and a round air outlet. An outside edge of the air inlet of the adapter is consistent in position with an end surface of the second scroll plate. The projection of the air outlet of the adapter is located within a projection plane of the air inlet and connected to the outside edge of the air inlet.

A flexural portion is formed to bend an air flowing direction at the casing plate and the adapter in a wind path between an expanding portion formed by the sirocco fan and the adapter and the air outlet of the adapter.

A tongue portion is disposed at a position closest to outside of fan blades in the casing plate. The flexural portion is formed by a first bending portion and a second bending portion, which are continuous to each other and bend the air flowing direction, at the tongue portion and a portion joined with an opposite side relative to the tongue portion and at the air outlet of the sirocco fan.

The expanding portion extends to an opposite side relative to the tongue portion to provide a first straight portion of the casing plate. The opposite side relative to the tongue portion linearly extends towards the air outlet of the ventilating fan to provide a second straight portion of the casing plate. The first and second straight portions at a peripheral portion of the casing compose the first bending portion to inwardly bend the wind path, and the second straight portion and a round portion of the adapter compose the second bending portion to outwardly bend the wind path. The first and second bending portions compose the flexural portion.

A tongue portion is disposed at a position closest to outside of fan blades of the casing plate. The expanding portion extends to an opposite side relative to the tongue portion to provide a first straight portion of the casing plate. The opposite side relative to the tongue portion linearly extends towards the air outlet of the ventilating fan to provide a second straight portion of the casing plate. The tongue portion linearly extends towards the air outlet of the ventilating fan to provide a third straight portion of the casing plate. The first and second straight portions at a peripheral portion of the casing compose the first bending portion to inwardly bend the wind path, the second straight portion and a round portion of the adapter compose the second bending portion to outwardly bend the wind path, and the third straight portion and the round portion of the adapter compose a third bending portion to inwardly bend the wind path. The first, second and third bending portions compose the flexural portion.

The expanding portion extends to an opposite side relative to the tongue portion to provide a first straight portion of the casing plate. The opposite side relative to the tongue portion linearly extends towards the air outlet of the ventilating fan to provide a second straight portion of the casing plate. The first and second straight portions at a peripheral portion of the casing compose the first bending portion to inwardly bend the wind path, and the second straight portion and a round portion of the adapter compose the second bending portion to outwardly bend the wind path. A bending extent of the second bending portion is smaller than that of the first bending portion.

Further, the adapter of the present invention comprises an air guiding structure and a shutter mounted inside the air guiding structure, the air guiding structure is divided into two parts of an air inlet and an air outlet. A sidewall forms a smooth transition connection between the air inlet and the air outlet. A shape of the air inlet is the same with a shape of the air outlet of the sirocco fan so as to form a communicating structure for direct and undisturbed connection. The shutter has an arcuate structure bending from a centre to both sides so as to match the shape of the air outlet and the shutter is fixed on an indoor side of the air outlet.

The air outlet of the air guiding structure is located in a projection plane of the air inlet of the air guiding structure and offset to be connected with an edge of the air inlet.

A central axis of the air outlet of the air guiding structure is offset towards the air inlet relative to the central axis of the air inlet of the air guiding structure.

The air guiding structure is integrally formed by injection moulding with resin.

Retainers are provided around the air guiding structure to fix the adapter inside the metal adapter.

Retainers are provided around the air guiding structure, the retainers comprise a plurality of elastic clips disposed on the periphery of the adapter of which each front end is provided with a protrusion, and a wall of the air outlet of the metal adapter is provided with a plurality of openings at positions corresponding to the protrusions.

The shutter has a thin structure and air guiding sheets are provided both on a lower surface of the air guiding structure close to the outdoor side and on an upper surface of the air guiding structure close to the indoor side.

The present invention is advantageous in that no turbulence is generated at the adapter and the wind amount of the ventilating fan is thus ensured and noise is reduced. Therefore, the present invention can provide a small air blowing device with high efficiency and improve stability of performance of the product.

DETAILED DESCRIPTION OF THE EMBODIMENTS

Figure 1:
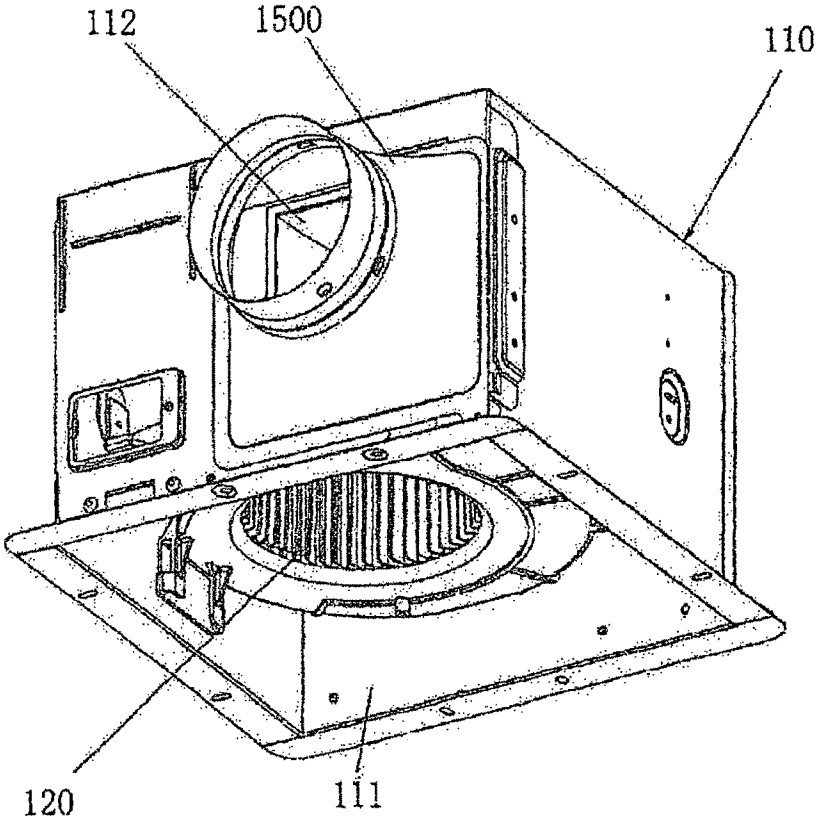
Fig. 1 PRIOR ART
FIG. 1 is a schematic view of the prior art.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
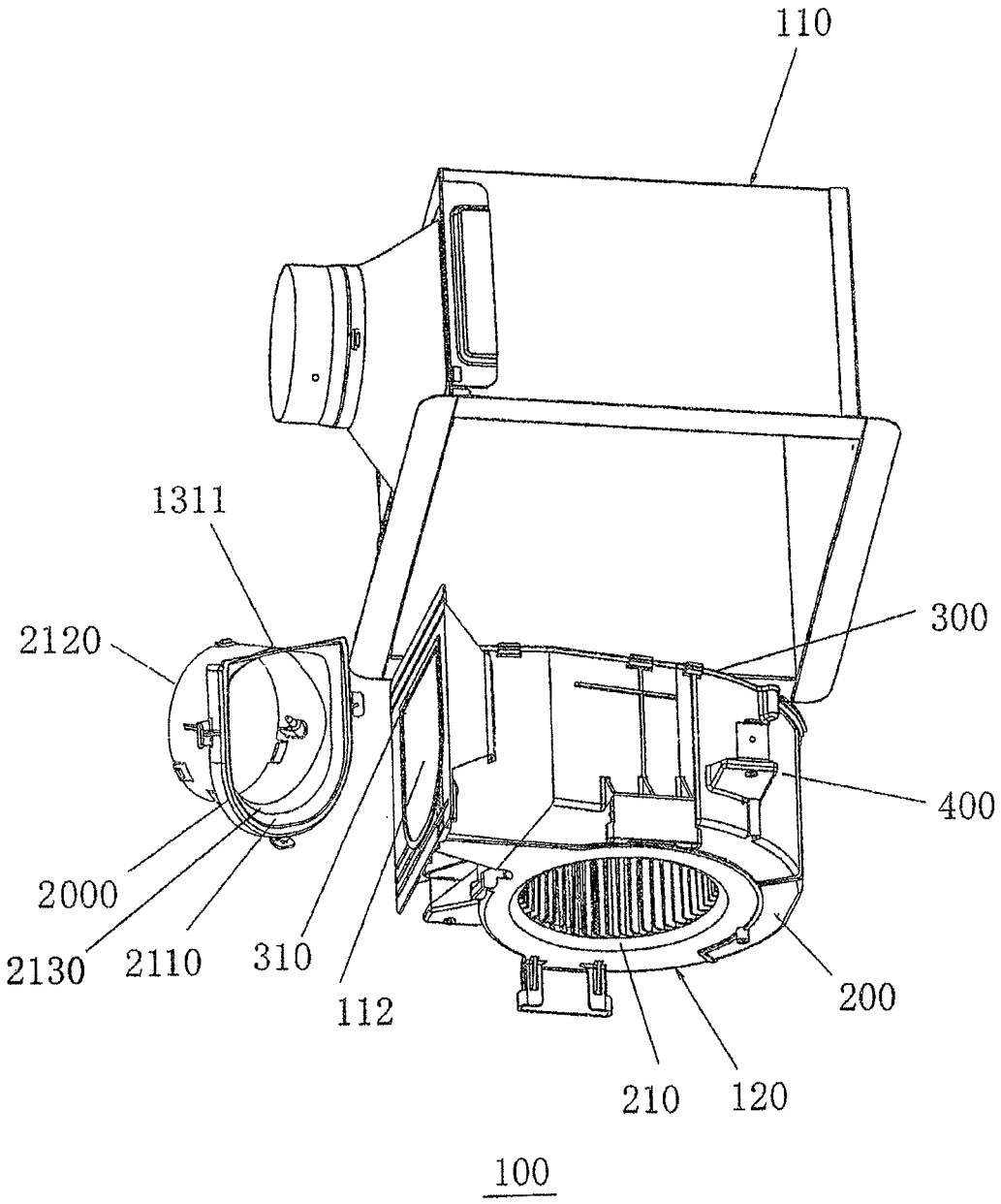
FIG. 2 is a structural view of a sirocco fan and a adapter formed of a resin according to an embodiment of the present invention.
Figure 3:
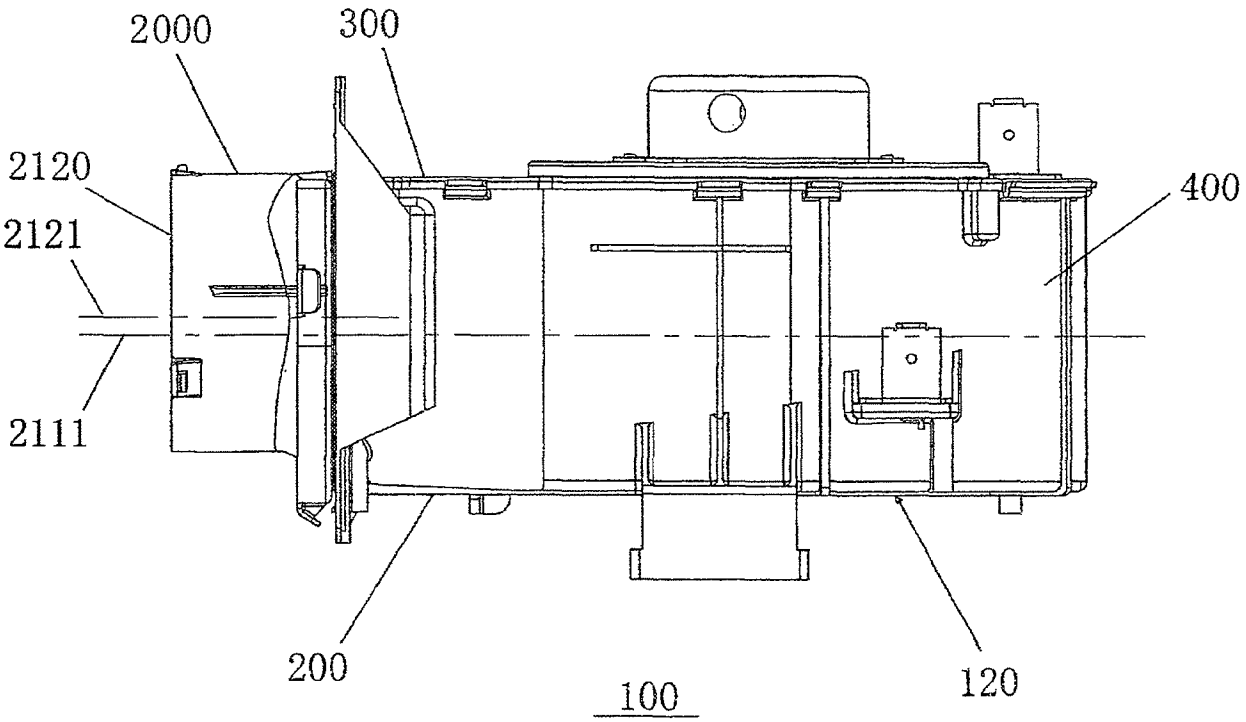
FIG. 3 is an entirely schematic view of the embodiment of the present invention.

FIGS. 2 and 3 show schematic views of an embodiment of the present invention. A ventilating fan 100 comprises a sirocco fan 120 disposed in a box-shaped body 110 and an adapter 2000 connected with a square air outlet 112 of the sirocco fan 120. The sirocco fan 120 is composed of a first scroll plate 200 and a second scroll plate 300, which have opposite complementary shapes, and a casing plate 400 sandwiched between the two scroll plates. An overall air inlet 210 of the sirocco fan is disposed on the first scroll plate 200. The adapter 2000 has a square air inlet 2110 and a round air outlet 2120 of which a central line 2121 is offset towards the second scroll plate 300.

It is noted that the adapter of the prior art as shown in FIG. 1 is a component formed of a metal. However, the adapter according to the present invention is a adapter formed of a resin.

The following description is made with reference to actual flow of air in the adapter 2000 therein.

The central line 2121 of the round air outlet 2120 is offset towards the second scroll plate 300 as described above. That is to say, an outside edge 1311 of the air inlet 2110 of the adapter 2000 is consistent in position with an end surface 310 of the second scroll plate 300, and projection of the air outlet 2120 of the adapter 2000 towards the sirocco fan 120 is fell within the air inlet 2110 and connected to the outside edge 1311. Therefore, a distance between the central line 2121 of the round air outlet 2120 and the second scroll plate 300 is smaller than a distance between the central line 2121 of the round air outlet 2120 and the first scroll plate 200. The central line 2121 is disposed to be closer to the second scroll plate 300 rather than right in the middle between the first scroll plate 200 and the second scroll plate 300.

As described above, the outside edge 1311 of the air inlet 2110 of the adapter 2000 is consistent in position with the end surface 310 of the second scroll plate 300. In other words, projection of the air outlet 2120 of the adapter 2000 is connected with the outside edge 1311 of the air inlet 2110 of the adapter 2000 in a projection plane, and the air outlet 2120 of the adapter 2000 is offset from the central line of the sirocco fan. Accordingly, although the wind blown by the sirocco fan 120 is not uniform, resistance suffered by the wind when the wind flows from the air inlet 2110 to the air outlet 2120 of the adapter 2000 becomes less since the outside edge 1311 of the air inlet 2110 can be located in the same plane with the end surface 310 of the second scroll plate 300. Therefore, more air streams are concentrated and the air streams flow smoothly. With the above structure, the wind blown by fan blades of the sirocco fan 120 more smoothly flow along the second scroll plate 300 as compared with the first scroll plate 200 which is provided with the overall air inlet 210 of the ventilating fan, so that wind beams at the second scroll plate 300 are more than wind beams at the first scroll plate 200.

That is to say, the wind blown through the air outlet 112 of the sirocco fan 120 is slowly bent from the air inlet 210 of the ventilating fan, concentrated along the second scroll plate 300, and then blown out. The first scroll plate 200 and the air inlet 210 are located in the same plane so that the wind passing through the fan blades of the sirocco fan 120 cannot sharply flow towards the first scroll plate 200 in a flexural manner. Therefore, the square air outlet 112 of the sirocco fan can be smoothly transformed to a round duct (not shown) by reducing the wind path area from the first scroll plate 200 to the second scroll plate 300 to decrease influence on the air streams where the air outlet 2120 of the adapter 2000 is disposed to be closer to the second scroll plate 300.

In other words, the adapter 2000 does not narrow on a side closer to the second scroll plate 300. The wind path area can be reduced in a short distance by greatly narrowing the adapter 2000 on a side closer to the first scroll plate 200 to reduce effect generated by the reduction of the adapter. This can prevent occurrence of the turbulence so as to easily ensure the wind amount. Further, noise can be further reduced.

Furthermore, the narrowing of the wind path at the adapter 2000 means that a smoothly narrow shape can be easily formed by slidingly molding a mould in the air flowing direction when the adapter 2000 is being molded. A portion of the ventilating fan may be narrowed on the fan side, i.e. the sirocco fan 120 side. However, this narrowing on the fan side is made at a portion close to the fan blades so that the narrowing cannot be achieved in a short distance. This is because the air blown by the fan blades directly collides with the narrow portion so as to generate turbulence, so that the narrowing on the fan side must be made in a long distance. That is to say, the narrowing of the adapter 2000 in the present embodiment is the most desirable.

In addition, the adapter 2000 may be set to be shorter with the above structure. Specifically, an adapter of the prior art formed of a metal may be used to maintain the length thereof when a shutter (not shown) is disposed at an opening end (i.e., on the outdoor side) of the air outlet 112 of the sirocco fan 120 during transforming the shape of the air outlet 112 of the sirocco fan 120 to the shape of the duct. The shutter may be disposed at a position closer to the body 110 of the ventilating fan as compared with the prior art. Therefore, a screw cannot contact with the shutter even if the screw is used to fix the duct and the metal adapter 1500 when the duct is mounted as in the prior art. That is to say, the adapter 2000 is capable of maintaining the same length with that of the metal adapter 1500 as shown in FIG. 1 even if there is a need for utilizing a space for the screw while ensuring mounting of the duct.

Figure 4:
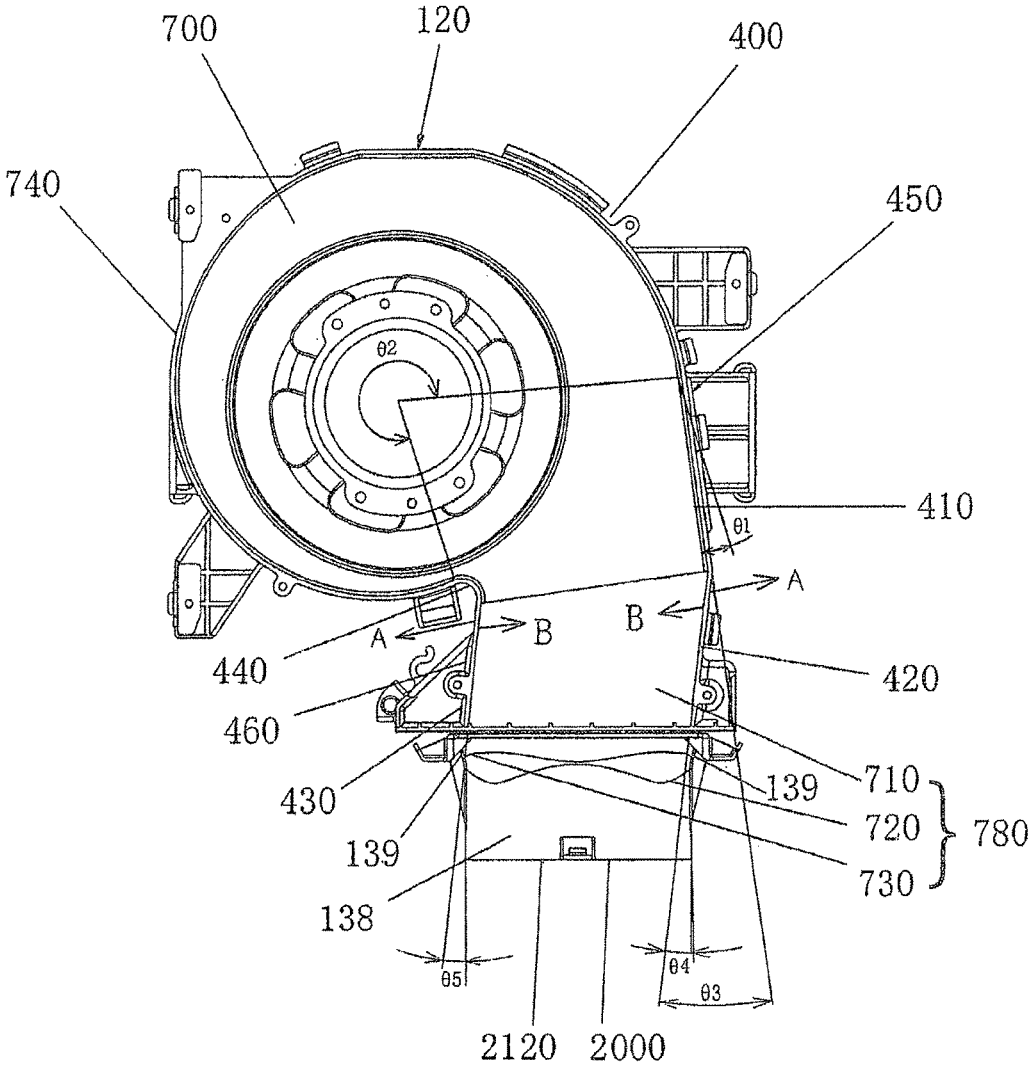
FIG. 4 is a schematically front elevation view of the sirocco fan and the adapter according to the present.
Figure 5:
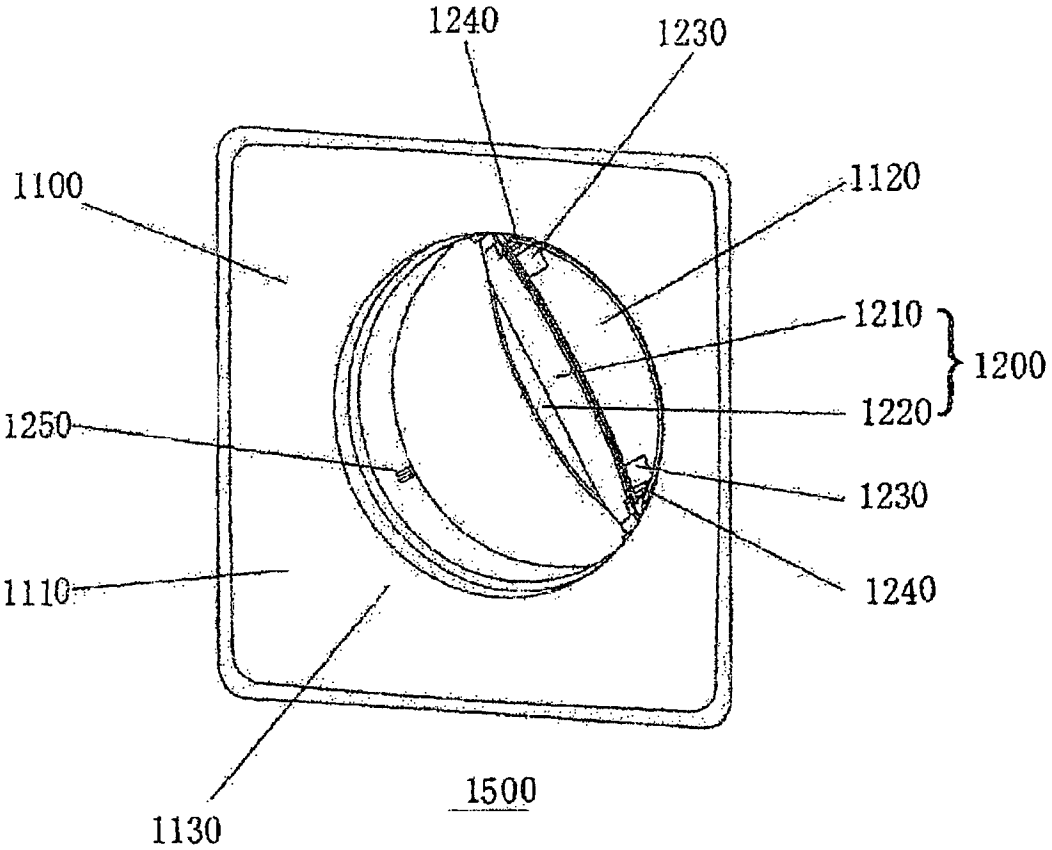
Fig. 5 PRIOR ART
FIG. 5 is a schematic view of an air guiding structure of the prior art.
Figure 6:
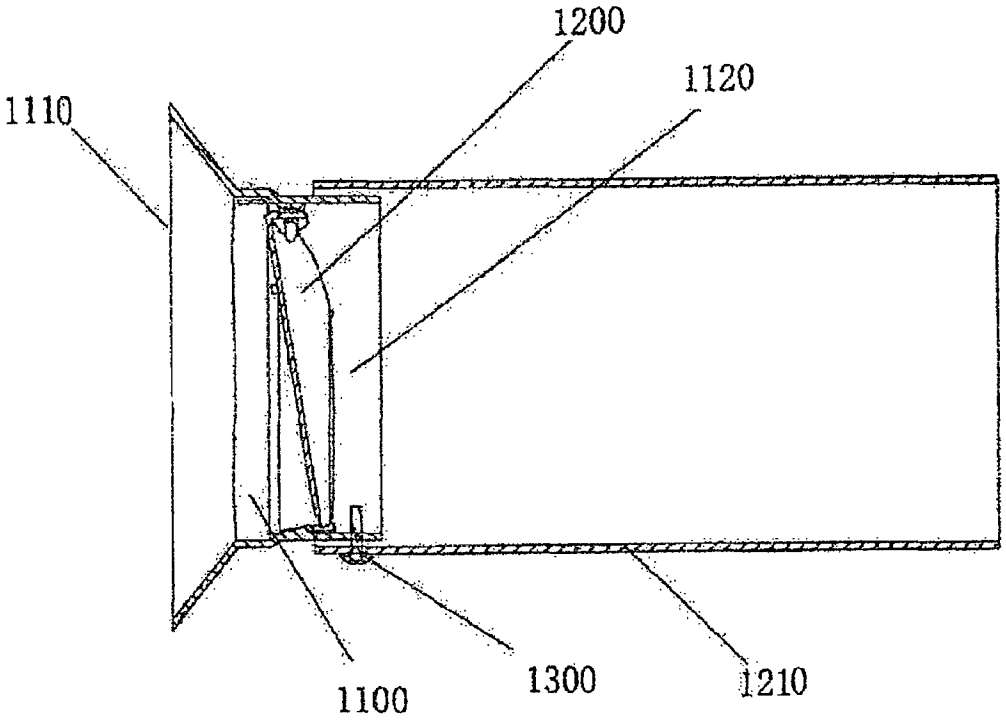
Fig. 6 PRIOR ART
FIG. 6 is a schematic view showing false mounting in the prior art.

FIG. 4 shows a front elevation view of the sirocco fan 120 and the adapter 2000. It is apparent from the drawing that a wind path 700 of the present invention includes a flexural portion 780 in order to further ensure wind amount and reduce noise.

A tongue portion 440 is disposed at a position closest to outside of the blades in the casing plate 400. An expanding portion 740 is provided for expanding the wind path 700 in a rotating direction of the fan blades at an extending portion from the tongue portion 440. A first straight portion 410 of the casing plate 400 is provided in an extension of the expanding portion 740, which is configured by extending to an opposite side 450 of the tongue portion 440. The opposite side 450 relative to the tongue portion 440 linearly extends towards the air outlet 2120 of the ventilating fan to provide a second straight portion 420 of the casing plate 400. The tongue portion 440 linearly extends towards the air outlet 2120 of the ventilating fan to provide a third straight portion 430 of the casing plate 400.

The first straight portion 410 inclines at an angle (θ1 shown in FIG. 4) of about 10 degree relative to a line connecting a centre of the fan blades and the tongue portion 440, and is disposed to be close to the air outlet 2120 of the ventilating fan. That is to say, the first straight portion 410 is disposed to suppress expansion of the wind path 700. For this purpose, the expanding portion 740 of the present embodiment is formed starting from the position of the tongue portion 440 within a range of 284 degree in the rotating direction of the fan blades.

The first and second straight portions 410, 420 at a peripheral portion of the casing compose a first bending portion 710 to inwardly bend the wind path. The second straight portion 420 and a round portion 138 of the adapter 2000 compose a second bending portion 720 to outwardly bend the wind path. The third straight portion 430 and the round portion 138 of the adapter 2000 compose a third bending portion 730 to inwardly bend the wind path. The first, second and third bending portions 710, 720, 730 compose the flexural portion 780. It is apparent from the above that the flexural portion 780 is formed by bending the air flowing direction at the casing plate 400 and the adapter 2000 in the wind path between the expanding portion 740, which is formed by the sirocco fan 120 and the adapter 2000, and the air outlet 2120 of the adapter 2000.

The direction of the outward bending is an expanding direction of a sidewall of the casing as indicated by the direction A in FIG. 4. The direction of the inward bending is a narrowing direction of the sidewall of the casing as indicated by the direction B in FIG. 4. However, a sectional area of the wind path 700 is not irregularly enlarged or reduced since the sectional area of the wind path 700 actually depends on relation between the bending extent of the opposite side 450 and the bending extent of another side 460.

The expansion of the wind path 700 is suppressed by the first straight portion 410 in a field between the tongue portion 440 and a connecting portion for joining the first and second straight portions 410, 420 at the opposite side 450 relative to the tongue portion 440. Therefore, a static pressure in the sirocco fan 120 can be more stable and disorder of the wind beams also can be prevented.

Further, the first bending portion 710 reduces a colliding angle of the air blown from the fan blades to the third straight portion 430 and thereby reduces turbulence arose at that portion. The direction of the air flowing along the first straight portion 410 side is modified by a centrifugal force of the fan blades in the second straight portion 420 of the opposite side 450 during a flowing process of the air towards the air outlet 112 of the sirocco fan 120. Moreover, the airstream modified in the first bending portion 710 is also micro-modified in the second bending portion 720 while the air flows from the air outlet 112 of the sirocco fan 120 to the adapter 2000.

It is clearly shown in the front elevation view of FIG. 4 that the airstream blown by the fan blades and having an unevenly horizontal direction can be modified by means of the third straight portion 430 disposed on the left side and the first and second straight portions 410, 420 disposed on the right side.

With the above structure, the wind blown by the fan blades flows along an inside of the casing plate 400 under action of the centrifugal force. Meanwhile, the air flowing direction of the air in the sirocco fan 120 is modified by means of the flexural portion 780, so that densities of the wind beams are uniform and the airstream is smooth. Further, the wind path is formed in a bending way due to the flexural portion 780. Therefore, noise generated by the fan blades collides with inside walls of the first and second straight portions 410, 430 or inside walls of the second straight portion 420 and the adapter 2000 while spreading towards the air outlet 2120 of the adapter 2000. That is to say, the noise can be reduced by repeated collision thereof.

As described above, the adapter 2000 is capable of smoothly transforming a square wind path into a round wind path in order to fit the shape of the duct. Therefore, the smooth airstream can be ensured in a narrow portion 139 even if the adapter 2000 symmetrically narrows in a left-right direction in the front elevation view of FIG. 4.

With reference to FIG. 4 again, a bending angle of the first bending portion 710 is θ3 and a bending angle of the second bending portion 720 is θ4. In the present embodiment, θ4<θ3, i.e. the second bending portion 720 bends slightly in a reverse direction as compared with the first bending portion 710. For example, θ3 is 14 degrees, θ4 is 6.5 degrees and θ5 is 6 degrees in the present embodiment.

The bending extent of the second bending portion 720 is less than the bending extent of the first bending portion 710. Therefore, a sound vibration generated when the air passing through the flexural portion 780 collides with the flexural portion 780 will not spread and is concentrated, and communicate with inside of the duct by means of the adapter 2000. In other words, the airstream modified in the first bending portion 710 is also micro-modified by the second bending portion 720 to ensure stability of the airstream and depress noise value.

Alternatively, the values of θ2~θ5 can be values different from the values defined in the above embodiment. The tilt angle of the first straight portion 410, the angles of the first and second straight portions 410, 420, the angle of the second straight portion 420 relative to the adapter 2000, the bending angles of the third straight portion 460 and the adapter 2000 may be in the range from 5 to 15 degrees, respectively. It is noted herein that dimensions of the angles are relative values. That is to say, θ3 may be about two times than θ4 and θ4 may be equal to θ5.

In addition, the sirocco fan 120 constructed by sandwiching the casing plate 400 between the first scroll plate 200 and the second scroll plate 300 is described in the present embodiment. Alternatively, the sirocco fan 120 is not necessary to be composed of components different to each other. For example, the first scroll plate 200 is formed of a piece of metal plate, and the second scroll plate 300 and the casing plate 400 are formed by integrally molding with a resin, or the first scroll plate 200 and the casing plate 400 are integrally formed by molding with a resin, and the second scroll plate 300 is formed of a metal plate.

When the first scroll plate 200 and the casing plate 400 is integrally formed by molding with a resin, a curved surface connection is the most desirable in order to achieve a smoother connection between the first scroll plate 200 and the casing plate 400 as described above. With this structure, the air outlet 112 of the sirocco fan 120 forms a right angle with respect to the second scroll plate 300 side and the first scroll plate 200 side forms in a curve.

Further, the air inlet of the adapter 2000 is disposed to have the same shape with the shape of the air outlet 112 within a range of the square shape of the air inlet 2110 so as to fit with that air outlet as shown in FIG. 2.

Inside and outside structures of the adapter 2000 according to the present invention are described in detail hereinafter.

Figure 7:
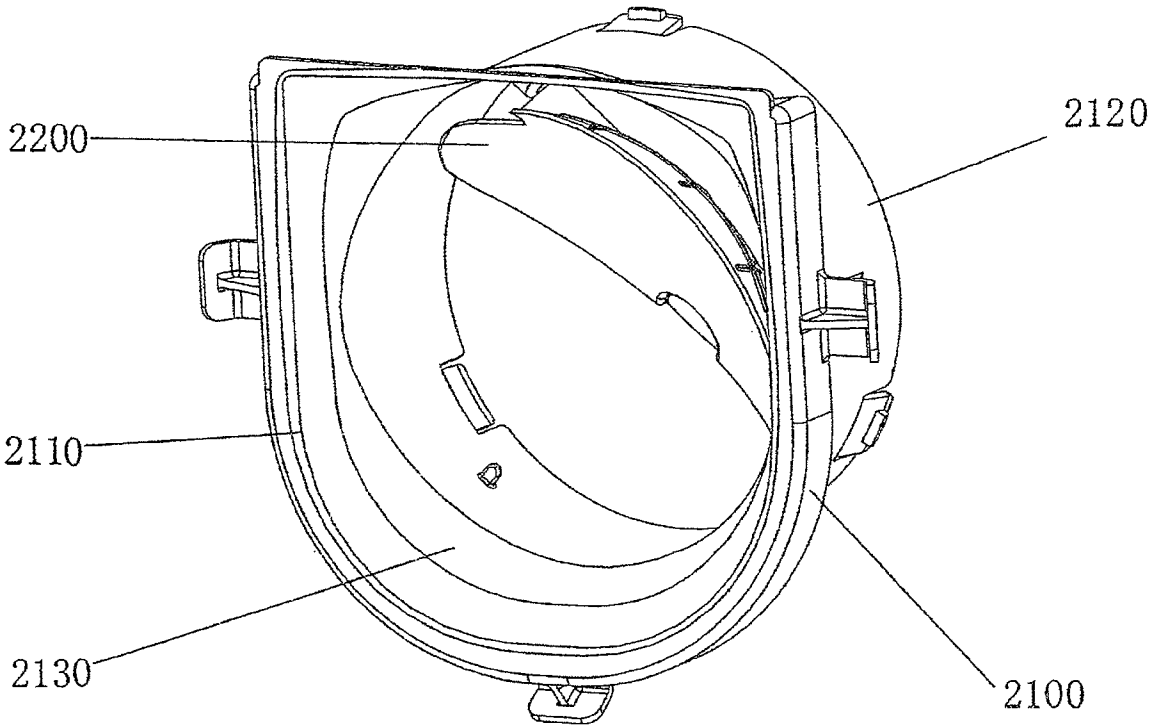
FIG. 7 is a schematic view of an air guiding structure according to the present invention.
Figure 8:
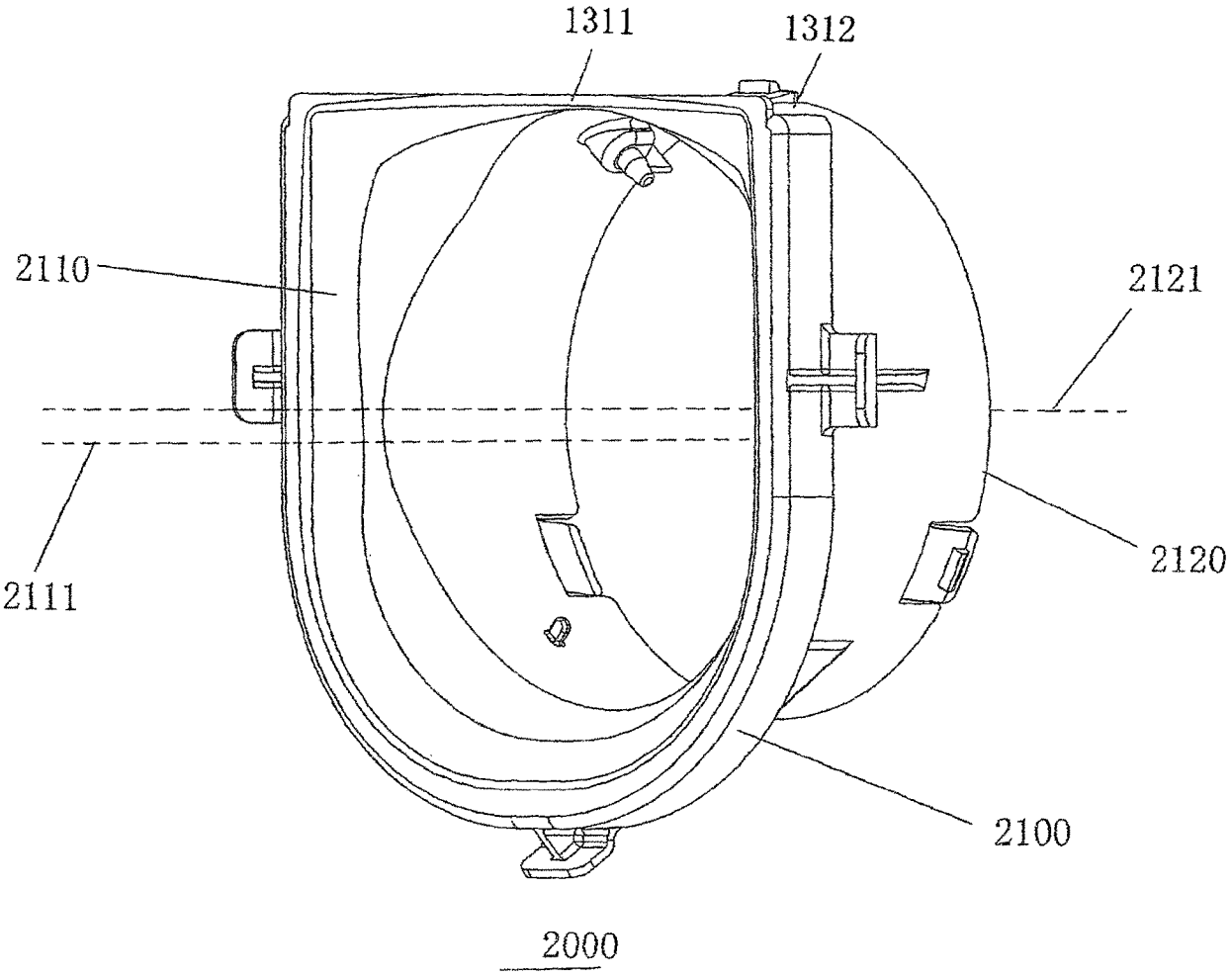
FIG. 8 is a schematic view showing the air guiding structure according to the present invention in another perspective.

FIGS. 7 and 8 show schematic views of an air guiding structure 2100. It is shown in FIG. 7 that the adapter 2000 of the ventilating fan comprises the air guiding structure 2100 and a shutter 2200 mounted inside the air guiding structure 2100. The air guiding structure 2100 is divided into two parts: an air inlet 2110 and an air outlet 2120. A sidewall 2130 forms a smooth transition connection between the air inlet 2110 and the air outlet 2120.

With reference to FIG. 2, a shape of the air inlet 2110 is the same with the shape of the air outlet of the casing provided with the fan such as the sirocco fan 120 so as to form a communicating structure for direct and unobstructed connection. The direct and unobstructed communicating structure means that the air inlet 2110 of the air guiding structure 2100 has a square shape and the air outlet 2120 has a round shape. The shape of the air inlet 2110 is disposed to be the same with the shape of the air outlet of the casing of the fan so that the section difference between the air outlet of the casing and the air inlet 2110 of the air guiding structure 2100 is reduced. Accordingly, the wind blown from the air outlet of the casing is smoothly guided and passes through the air inlet 2110 of the air guiding structure 2100. With the above structure, when the wind generated by the fan is blown towards the air inlet 2110 of the air guiding structure 2100, the wind cannot collide with the sidewall 2130 of the air inlet 2110 and thereby generate turbulence since the air guiding structure 2100 is designed to be a directly communicating structure for smoothly connecting with the casing provided with the fan. This will reduce noise and enhance wind amount.

FIGS. 3 and 8 show that the air outlet 2120 of the air guiding structure 2100 is offset towards the outside edge 1311 of the air inlet 2110 and connected thereto as described above. That is to say, the central axis 2121 of the air outlet 2120 of the air guiding structure 2100 is disposed to be offset towards the outside edge 1311 of the air inlet 2110 relative to the central axis 2111 of the air inlet 2110. The wind blown by the fan is not uniform. The resistance against round transform of the air outlet 2110 can be decreased in such a manner that the outside edge 1311 of the air inlet 2110 is consistent in position with an edge 1312 of the air outlet 2120 of the air guiding structure 2100. In other words, a side on which the fan blows more wind beams is aligned with the outside edge 1311 of the air inlet 2110. Accordingly, the air guiding structure 2100 is set to be shorter and the shape of the air outlet of the fan is transformed into the shape of the duct by means of the air guiding structure 2100 in the case that the metal adapter (not shown) of the prior art is still utilized. Therefore, a shutter (not shown) at the opening end (on the outdoor side) of the air outlet can be disposed to be closer to the body of the ventilating fan than the prior art.

Figure 9:
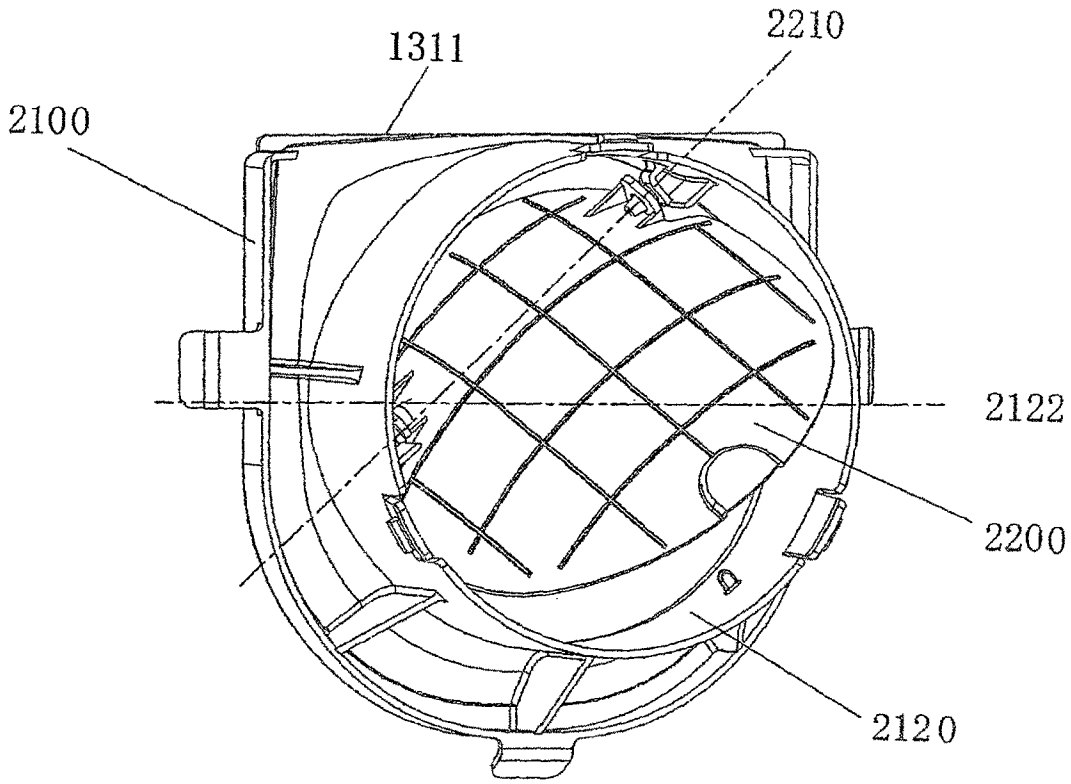
FIG. 9 is a schematic view of a shutter according to the present invention.

As shown in FIG. 9, the opening extent of the shutter can be ensured at the outside edge 1311 of the air inlet 2110 having more wind beams in such a manner that a rotational axis 2210 of the shutter is disposed to be offset towards the outside edge 1311 of the air inlet 2110, as viewed from the central axis 2122 dividing the air outlet 2120 into an upper and lower parts. Strong wind beams are required to open the shutter at a portion near the rotational axis 2210. Therefore, the opening state of the shutter is more easily stabilized by blowing the strong wind beams towards the portion near the rotational axis 2210 of the shutter than the case that the strong wind beams is blown towards a front end of the shutter away from the rotational axis 2210. Further, a larger opening extent can be achieved, thereby preventing turbulence generated by weight of the shutter, reducing noise and enhancing wind amount.

Again with reference to FIG. 7, the air guiding structure 2100 of the present embodiment is integrally formed by molding with a resin. However, in the prior art, the one air guiding structure 1100, the two sheaths 1230, the two rivets 1240 and the one rubber buckle 1250 are assembled to be integral in the metal adapter 1500 of the prior art. Therefore, in the present embodiment, the adapter 2000 is composed of the shutter 2200 and the air guiding structure 2100. The structure of the adapter 2000 of the present embodiment is different from that of the prior art in which the shutter 2200 is fixed in the adapter by five components such as the two sheaths 1230, the two rivets 1240 and the one rubber buckle 1250. It is apparent from the above that the present invention can reduce work hours and thus cost while raw material is saved. Moreover, the resin with a light weight facilitates to successfully open the shutter 2200, thereby reducing noise, ensuring wind amount and improving stability of performance of the product.

FIG. 9 is a schematic view of the shutter according to the present invention. The shutter 2200 has an arcuate structure bending from a centre to both sides so as to match the shape of the air outlet 2120, and is fixed in the air outlet 2120 near an indoor side, as shown in FIG. 9. The arcuate structure indicates that the shutter 2200 is disposed to bend from the centre to the both sides, i.e. the shutter 2200 is entirely disposed to have a tortoiseshell shape. The indoor side of the air outlet 2120 is a side close to the air outlet of the casing.

Since the shutter 2200 is designed to be the arcuate structure so as to match the shape of the air outlet 2120 of the air guiding structure 2100, the arcuate structure is capable of tightly fitting with the air outlet 2120 of the air guiding structure 2100 to prevent occurrence of a slit and thus poor tightness.

The shutter 2200 is designed to have a thin structure which is light in weight in the present embodiment. The shutter 2200 is fixed in the air outlet 2120 of the air guiding structure 2100 near the indoor side, i.e. the shutter 2200 is close to the casing provided with the fan, so as to enlarge a wind pressure. A thickness of the shutter 2200 changes from 1.2 mm of the prior art to a thickness of 0.8 mm since the shutter 2200 is designed to have the thin structure which is light in weight. The shutter 2200 is more easily opened under action of the wind blown by the casing if the outer surface of the shutter 2200 is further provided with reinforcing ribs having a grid shape. This contributes to reduce noise.

Figure 10:
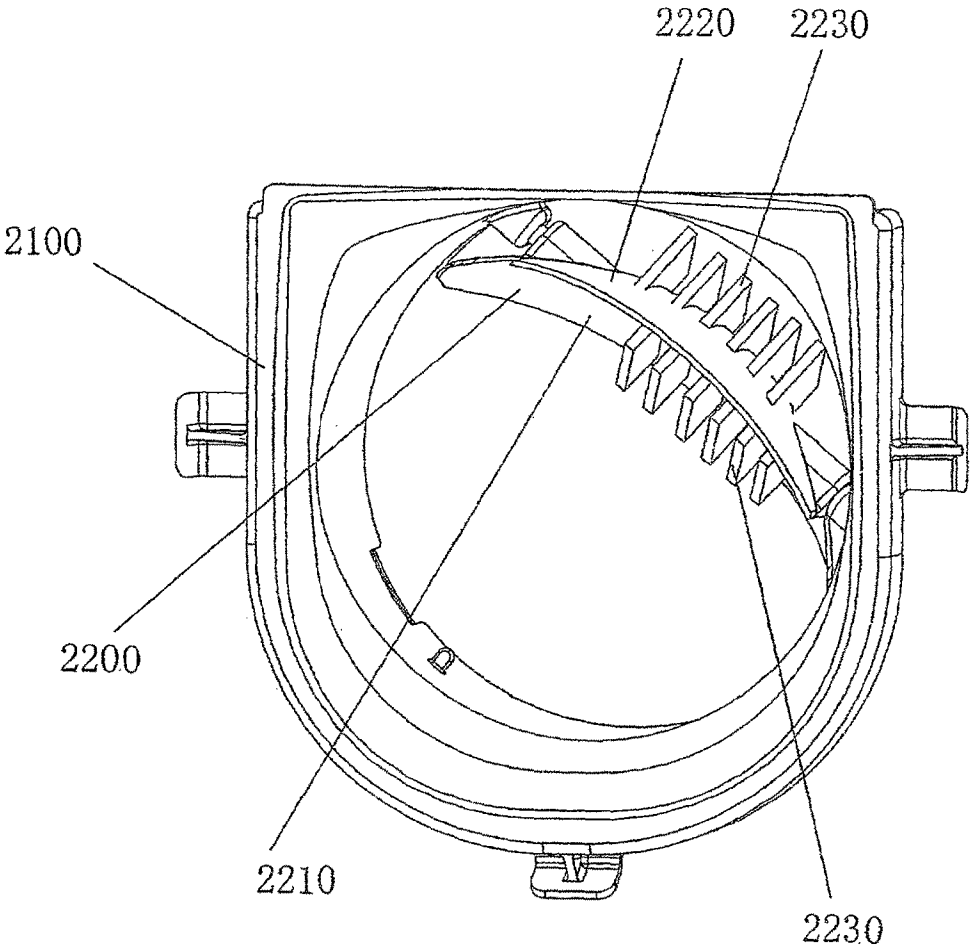
FIG. 10 is a schematic view of a shutter according to another embodiment of the present invention.

FIG. 10 is a schematic view of a shutter according to another embodiment of the present invention. The air guiding structure 2100 is provided with a shutter 2200 on a lower surface 2210 close to the outdoor side and air guiding sheets 2230 on an upper surface 2220 close to the indoor side, as shown in FIG. 10. With this structure, the wind blown from the casing provided with the fan can successfully pass through the shutter 2200 by means of the air guiding sheets 2230 disposed on the shutter 2200 without turbulence, thereby ensuring the wind amount and improving stability of performance of the product.

Figure 11A:
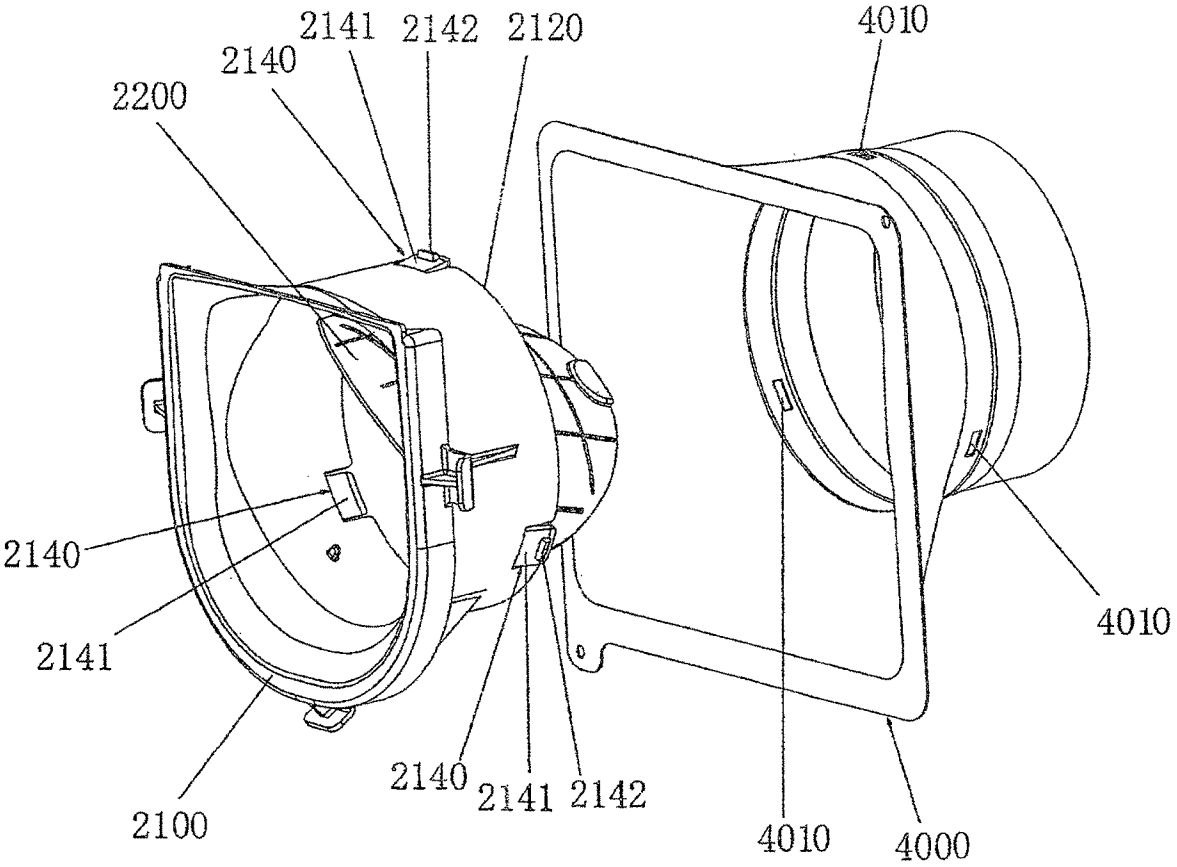
FIGS. 11A and 11B are schematic views in which the air guiding structure according to the present invention is mounted in a known metal adapter.
Figure 11B:
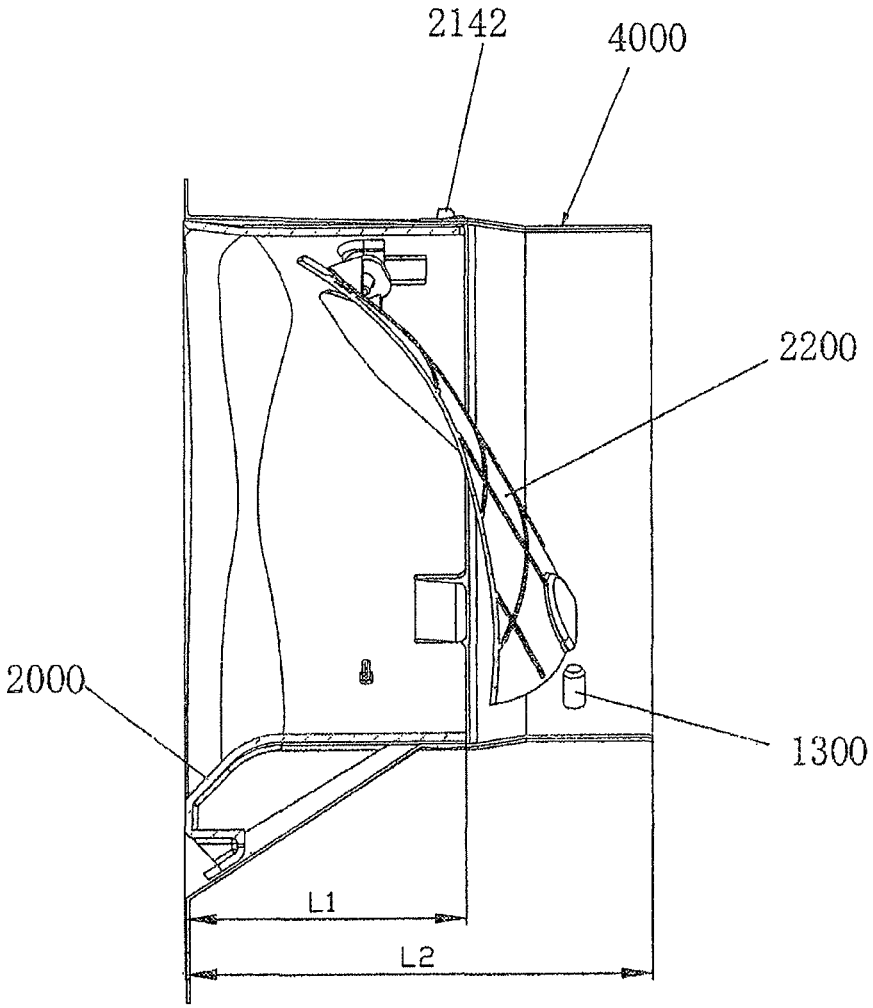

FIGS. 11A and 11B are schematic views showing that the air guiding structure of the present invention is mounted in the metal adapter of the prior art. FIG. 11A shows that a plurality of retainers 2140 are provided around the air guiding structure 2100 of the present invention. The retainers 2140 comprise a plurality of elastic clips 2141 disposed on the periphery of the adapter 2000 of which each front end is provided with a protrusion 2142. A wall of an air outlet of a metal adapter 4000 as the prior art is correspondingly provided with a plurality of openings 4010. When the adapter 2000 is caught in the metal adapter 4000, the protrusions 2142 disposed on the front ends of the plurality of elastic clips 2141 guide the adapter 2000 along the inside wall of the metal adapter 4000 to smoothly catch the adapter 2000 in the metal adapter 4000. When the adapter 2000 is caught at a certain position in the metal adapter 4000, the protrusions 2142 on the front ends of the clips 2141 are caught in the openings 4010 of the air outlet of the metal adapter 4000 under elastic action of the clips 2141 and the adapter 2000 is thus firmly fixed in the metal adapter 4000. The air guiding structure 2100 of the present invention is fixed inside the metal adapter 4000 to sufficiently share the existing components. Further, the adapter structure composed of two layers of metal and resin improves aesthetics and quality of the product.

In above air guiding structure 2100 of the present invention, the shape of the air outlet of the fan can be transformed into the shape of the duct in a shorter distance than the metal adapter 1500 of the prior art. That is to say, the shape of the air outlet of the fan is transformed into the shape of the duct by means of the air guiding structure 2100 while maintaining an entire length of the metal adapter 1500 of the prior art. The shutter 2200 located at the opening end (on the outdoor side) of the air outlet 2120 of the air guiding structure 2100 can be disposed to be closer to the body side of the ventilating fan than the prior art. Therefore, when the duct is mounted in the same way as the prior art, the screw 1300 cannot contact with the shutter 2200 even if the screw 1300 is used as shown in FIG. 11B. In the present embodiment, the position of the shutter 2200 is positioned at about 30 mm closer to the indoor side than that of the prior art, thereby improving stability of performance of the product. Moreover, a length L1 of the above adapter is smaller than a length L2 of the metal adapter of the prior art. The screw 1300 cannot interfere with the adapter to prevent opening of the shutter 2200 disposed in the metal adapter 4000 even if the screw 1300 is longer so as to protrude from the wall of the metal adapter 4000, when the mounter fixes the duct on the metal adapter 4000 by the screw 1300. This can avoid the case that the shutter 2200 cannot be opened and closed due to assembly of a screw during mounting of the ventilating fan, thereby improving stability of performance and easy assembly of the product.

What is claimed is:

1. A ventilating fan, comprising:

a sirocco fan disposed in a box-shaped body; and an adapter connected to an air outlet of the sirocco fan, the adapter having a D-shaped air inlet and a round air outlet, the ventilating fan is characterized in that the sirocco fan is composed of two opposite scroll plates with scroll shapes and a casing plate sandwiched between the two scroll plates, an overall air inlet of the sirocco fan is disposed on the first scroll plate, and a central line of the air outlet of the adapter is offset towards the second scroll plate; and an outside edge of the air inlet of the adapter is aligned with an end surface of the second scroll plate, and a projection of the air outlet of the adapter toward the air inlet of the adapter is within the air inlet of the adapter and connected to the outside edge of the air inlet; and a smooth transition structure is formed between the D-shaped air inlet and the round air outlet;

wherein the air inlet of the adapter is greater in size than the air outlet of the adapter;

wherein a straight edge of the D-shaped air inlet of the adapter is aligned with the end surface of the second scroll plate;

wherein the casing plate comprises a tongue portion at a position closest to an outer circumference of fan blades of the sirocco fan as viewed in a radial direction, and an expanding portion expanded from the tongue portion to an air outlet of the sirocco fan in a rotating direction of the fan blades;

wherein a flexural portion to bend an air flowing direction is formed by the casing plate and the adapter in a wind path between the expanding portion of the sirocco fan and the air outlet of the adapter, and wherein the expanding portion extends to an opposite side relative to the tongue portion to provide a first straight portion of the casing plate;

the opposite side relative to the tongue portion linearly extends towards the air outlet of the ventilating fan to provide a second straight portion of the casing plate;

the tongue portion linearly extends towards the air outlet of the ventilating fan in an expanding direction of a sidewall of the casing plate to provide a third straight portion of the casing plate;

wherein from an upstream side to a downstream side of the air flowing direction, the first straight portion is inclined inwardly in a narrowing direction of the sidewall of the casing plate with respect to a line connecting a center of the fan blades and the tongue portion, and the second straight portion is inclined inwardly in a further narrowing direction of the sidewall of the casing plate with respect to the first straight portion, a round portion of the adapter is outwardly inclined in the expanding direction of the sidewall of the casing plate with respect to the second straight portion, and the round portion of the adapter is inwardly inclined in the narrowing direction of the sidewall of the casing plate with respect to the third straight portion, the first and second straight portions at a peripheral portion of the casing plate form a first bending portion to as a whole inwardly bend the wind path in the narrowing direction of the sidewall of the casing plate, the second straight portion and the round portion of the adapter form a second bending portion to outwardly bend the wind path in the expanding direction of the sidewall of the casing plate, and the third straight portion and the round portion of the adapter form a third bending portion to inwardly bend the wind path in the narrowing direction of the sidewall of the casing plate, such that the first bending portion and the second bending portion are bent in opposite directions, and the second bending portion and the third bending portion are bent in a same direction; and the first, second and third bending portions form the flexural portion.

2. The ventilating fan according to claim 1, wherein the first bending portion and the second bending portion are on an opposite side relative to the tongue portion, and are continuous to each other and bend the air flowing direction.

3. The ventilating fan according to claim 1, wherein a bending extent of the second bending portion is smaller than that of the first bending portion.

4. The ventilating fan according to claim 1, wherein the adapter comprises an air guiding structure and a shutter mounted inside the air guiding structure, the air guiding structure is divided into two parts: the air inlet and the air outlet, wherein a sidewall forms the smooth transition structure between the air inlet and the air outlet, a shape of the air inlet is the same as a shape of the air outlet of the sirocco fan so as to form a directly communicating structure for connection;

wherein the shutter has an arcuate structure bending from a center to both sides so as to match the shape of the air outlet; and wherein the shutter is fixed on an indoor side of the air outlet.

5. The ventilating fan according to claim 4, wherein the projection of the air outlet of the air guiding structure toward the air inlet of the air guiding structure is within the air inlet of the air guiding structure and is offset to be connected with an edge of the air inlet of the air guiding structure.

6. The ventilating fan according to claim 4, wherein a central axis of the air outlet of the air guiding structure is offset towards the air inlet relative to the central axis of the air inlet of the air guiding structure.

7. The ventilating fan according to claim 4, wherein the air guiding structure is integrally formed by injection moulding with a resin.

8. The ventilating fan according to claim 4, wherein retainers are provided around the air guiding structure to fix the adapter inside a metal adapter.

9. The ventilating fan according to claim 4, wherein retainers are provided around the air guiding structure, the retainers comprise a plurality of elastic clips disposed on the periphery of the adapter of which each front end is provided with a protrusion, and a wall of an air outlet of a metal adapter is provided with a plurality of openings at positions corresponding to the protrusion.

10. The ventilating fan according to claim 4, wherein the shutter is provided with air guiding sheets both on a lower surface of the shutter adjacent to the outdoor side and on an upper surface of the shutter adjacent to the indoor side.

11. The ventilating fan according to claim 1, wherein the central line of the air outlet of the adapter is offset from a central line of the air inlet of the adapter.

12. The ventilating fan according to claim 11, wherein the central line of the air inlet of the adapter is aligned with a central line of the air outlet of the sirocco fan.

13. The ventilating fan according to claim 11, wherein the central line of the air outlet of the adapter is positioned closer to the end surface of the second scroll plate than the central line of the air inlet of the adapter.

14. The ventilating fan according to claim 1, wherein an outside edge of the air outlet of the adapter is aligned with the end surface of the second scroll plate.

* * * * *